United States Patent [19]

Ohga et al.

[11] Patent Number: 4,888,334

[45] Date of Patent: Dec. 19, 1989

[54] PRESSURE-SENSITIVE MICROCAPSULE SHEET

[75] Inventors: Kunihiko Ohga; Keiso Saeki, both of Shizuoka, Japan

[73] Assignee: Fuji Photo Film Co., Ltd., Kanagawa, Japan

[21] Appl. No.: 183,104

[22] Filed: Apr. 19, 1988

[30] Foreign Application Priority Data

Apr. 20, 1987 [JP] Japan ..... 62-97092

[51] Int. Cl.[4] ..... B41M 5/16

[52] U.S. Cl. ..... 503/214; 427/150; 428/914; 503/215

[58] Field of Search ..... 427/150–152; 428/913, 914; 503/214, 215

[56] References Cited

U.S. PATENT DOCUMENTS 4,125,675 11/1978 Sekiguchi et al. ..... 503/214

FOREIGN PATENT DOCUMENTS 0186516 7/1986 European Pat. Off. ..... 503/214
2174425A 11/1986 United Kingdom ..... 503/214
2102855A 2/1988 United Kingdom ..... 503/214

*Primary Examiner*—Bruce H. Hess
*Attorney, Agent, or Firm*—Sughrue, Mion, Zinn, Macpeak & Seas

[57] ABSTRACT

A pressure-sensitive microcapsule sheet comprising a support having thereon a pressure-sensitive layer comprising microcapsules and a binder comprising a copolymer latex composed of at least two monomers selected from the group consisting of an aliphatic conjugated diolefin monomer, an aromatic vinyl monomer and an ethylenically unsaturated nitrile monomer and an ethylenically unsaturated acid amide monomer. The sheet is free from color stain and fog during printing.

11 Claims, No Drawings

PRESSURE-SENSITIVE MICROCAPSULE SHEET

FIELD OF THE INVENTION

The present invention relates to a pressure-sensitive recording sheet, and more precisely, to a pressure-sensitive recording sheet capable of forming a color image by reaction of an electron donating color former and an electron accepting developer.

BACKGROUND OF THE INVENTION

There are various kinds of pressure-sensitive recording sheets including, for example, the combination of an upper sheet having formed on a support a micro-capsule layer, which contains microcapsules of oil drops of an almost colorless electron donating color former dissolved in a solvent, and a lower sheet having an electron accepting developer-containing developer layer formed on another support, and optionally a middle sheet having a microcapsule layer on one side of a support and a developer layer on the other side thereof. Other sheets have the above described microcapsules and developer on the same surface of a support, or either one of the microcapsules or developer incorporated into a support and the other coated thereon.

These pressure-sensitive recording sheets are described, for example, in U.S. Pat. Nos. 2,505,470, 2,505,489, 2,550,471, 2,730,457 or 3,418,250.

One important characteristic of pressure-sensitive recording sheets is that the sheets be able to form sharp color images when written or printed under pressure with a ball-point pen or a typewriter, without being color-stained by pressure during manufacture, processing, transportation or storage. In addition, it also is important that the sheets not be stained and the color forming capacity thereof not be lowered, even when they are exposed to water, solvents and heat.

A coacervation method using gelatin has been utilized for microcapsulation of coating compositions for pressure-sensitive recording sheets as described, for example, in U.S. Patent 2,800,457, but recently, various kinds of microcapsulation methods using synthetic polymer materials for walls of microcapsules have been studied and developed. For example, there are a polymerization method for microcapsulation using polyamides, polyurethanes, polyureas, saturated polyesters, etc., as a material for microcapsule walls as described, for example, in British Patent 1,046,409, and an in situ method for microcapsulation using melamine-formaldehyde resins or urea-formaldehyde resins as a material for microcapsule walls as described, for example, in Japanese Patent Publication No. 30282/71.

As a binder for binding the microcapsules thus formed to a support, water-soluble polymers such as polyvinyl alcohol, starch, dextrin, carboxymethyl cellulose, casein, etc., have heretofore been used. The binder is required not to bind microcapsules to a support but also to protect the microcapsules themselves from any external pressure so as to prevent color stain and fog during printing. However, since the above mentioned water-soluble polymers have poor elasticity by themselves, their function of protecting microcapsules is insufficient. Further, since they are poor in the oil swellability, their function of preventing fog during printing is also poor. Thickening the microcapsule walls or increasing the binder amount for the purpose of preventing color stain or fog during printing undesirably reduces the coloring capacity.

Japanese Patent Application (OPI) Nos. 72891/82 and 77589/82 (corresponding to British Patent 2,087,942) (the term "OPI" as used herein refers to a "published unexamined Japanese patent application") have proposed adding an acrylate polymer or ethylene-vinyl acetate copolymer in a microcapsule-containing coating composition so as to protect the microcapsule wall. However, the additive is insufficient in adhesive power and hardly prevents fog during printing, and therefore the coloring capacity and the prevention of color stain could not both be satisfied even by the use of the additive.

Japanese Patent Application (OPI) Nos. 97886/85 and 280985/86 have proposed adding a styrene-butadiene copolymer latex to a microcapsule-containing coating composition as an improvement of the above mentioned method. However, the latex essentially requires an ethylenically unsaturated acid monomer to improve the stability of the microcapsule-containing coating composition and the adhesive power of the composition with a support. The electron donating color former in the microcapusles can color because of the acid component, and, therefore, when the latex is used as a binder for microcapsules, the part in which the microcapsules have been broken is color-stained. In addition, if the part is exposed to light, the degree of the color stain is augmented.

SUMMARY OF THE INVENTION

An object of the present invention is to provide a microcapsule-containing sheet for pressure-sensitive copying, which is free from color stain fog during printing.

This and other objects of the present invention can be achieved by a pressure-sensitive microcapsule sheet composed of a support having thereon a pressure-sensitive layer comprising microcapsules and a binder comprising copolymer latex composed of at least two monomers selected from the group consisting of an aliphatic conjugated diolefin monomer, an aromatic vinyl monomer, and an ethylenically unsaturated nitrile monomer and an ethylenically unsaturated acid amide monomer.

DETAILED DESCRIPTION OF THE INVENTION

The copolymer latex which is the binder for microcapsules for use in the present invention is now described in detail.

The aliphatic conjugated diolefin monomer includes, for example, 1,3-butadiene, 2-methyl-1,3-butadiene, 2,3-dimethyl-1,3-butadiene, halogensubstituted butadienes, etc. The content of the aliphatic conjugated diolefin monomer in the. copolymer is preferably from about 15 to 70% by weight, more preferably from about 30 to 60% by weight.

The aromatic vinyl monomer includes, for example, styrene, α-methylstyrene, vinyltoluene, monochlorostyrene, etc. The content of the aromatic vinyl monomer in the copolymer is preferably from about 10 to 70% by weight, more preferably from about 20 to 60% by weight.

The ethylenically unsaturated acid amide monomer includes, for example, acrylic acid amide, N-methylolacrylamide, methacrylic acid amide, crotonic acid amide, cinnamic acid amide, itaconic acid amide, fumaric acid amide, maleic acid amide, itaconic acid amide monoethylester, fumaric acid amide monoethylester, maleic acid amide monoethylester, etc. The content of the ethylenically unsaturated acid amide monomer in the copolymer is preferably from about 0.5 to 20% by weight, more preferably from about 3 to 15% by weight.

The ethylenically unsaturated nitrile monomer includes, for example, acrylonitrile, methacrylonitrile, α-chloroacrylonitrile, etc. The content of the ethylenically unsaturated nitrile monomer in the copolymer is preferably from about 3 to 30% by weight, more preferably from about 5 to 20% by weight.

The copolymer latex for use in the present invention can be copolymerized with any other olefinic monomers which are copolymerizable with the above mentioned aliphatic conjugated diolefin monomers, aromatic vinyl monomers, ethylenically unsaturated acid amide monomers and ethylenically unsaturated nitrile monomers, and examples of such copolymerizable monomers include alkyl acrylates and methacrylates such as methyl acrylate, methyl methacrylate, ethyl acrylate or butyl acrylate, as well as glycidyl acrylate, glycidyl methacrylate, acrolein, allyl alcohol, divinylbenzene, diallyl phthalate, diallyl maleate, triallyl cyanurate, ethylene glycol dimethacrylate, allyl acrylate, vinylpyridine, etc.

The typical examples of the preferred copolymer latex for use in the present invention include 0/55/5/10, 45/45/5/5 or 50/37/3/10 (weight ratio) copolymer of 1,3-butadiene/styrene/acrylic acid amide/acrylonitrile, 30/50/10/10, 53/30/5/10 or 37/55/3/5 (weight ratio) copolymer of 1,3-butadiene/styrene/methacrylic acid amide/acrylonitrile, 40/40/4/16 or 0/50/5/15 (weight ratio) of 1,3-butadiene/styrene/acrylic acid amide/-methyl methacrylate, 35/35/10/15/5 or 30/53/5/10/2 (weight ratio) copolymer of 1,3butadiene/styrene/acrylic acid amide/acrylonitrile/ divinylbenzene, 37/55/3/5 or 45/40/5/10 (weight ratio) copolymer of 2-methyl-1,3-butadiene/styrene/acrylic acid amide/acrylonitrile, 37/55/3/5, 30/50/5/15 or 0/30/10/10 (weight ratio) copolymer of 1,3-butadiene/styrene/itaconic acid amide/acrylonitrile, 35/50/5/10, 5/40/5/10 or 50/35/10/5 (weight ratio) copolymer of 1,3-butadiene/-styrene/fumaric acid amide/methacrylonitrile, and 35/55/5/5 or 45/45/5/5 (weight ratio) copolymer of 1,3-butadiene/α-methylstyrene/acrylic acid amide/acrylonitrile.

The method for preparation of the copolymer latex for use in the present invention is not particularly limited, but any conventional emulsion polymerization, such as batchwise emulsion polymerization or continuous emulsion polymerization, can be employed therefor. Any of various conventional additives which are used in conventional emulsion polymerization, for example, known emulsifying agents, polymerization initiators, chelating agents, electrolytes, molecular weight regulating agents, etc., can be used, and the polymerization temperature may be either high or low. Further, any known pH adjusting agent, dispersing agent or antiseptic can be added to the copolymer latex after completion of the polymerization. The preparation methods are described, for example, in Shintaro Kunizawa et al., *Emulsion and Latex Handbook*, published by Taiseisha, pages 116 and 136.

In accordance with the present invention, the amount of the copolymer latex is from about 10 to 90 parts by weight, preferably from about 15 to 70 parts by weight, per 100 parts by weight (as solid content) of microcapsules in the coating composition.

The color former used in the recording sheet of the present invention is not specifically limited. Examples of the color former include triarylmethane compounds, diphenylmethane compounds, xanthene compounds, thiazine compounds, spiro compounds and mixtures of these compounds. Specific examples of triarylmethane compounds include 3,3-bis(p-dimethylaminophenyl)-6dimethylaminophthalide (namely, Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1/2-dimethylindol-3-yl)-6dimethylaminophthalide, 3,3-bis(9-ethylcarbazol-3-yl)5-dimethylaminophthalide, 3,3-bis(2-phenylindol-3-yl)5-dimethylaminophthalide and 3-p-dimethylaminophenyl-3(1-methylpyrrol-2-yl)-6-dimethylaminophthalide. Specific examples of diphenylmethane compounds include 4,4'-bisdimethylaminobenzhydrin benzyl ether, N-halophenyl leuco Auramine and N-2,4,5-trichlorophenyl leuco Auramine. Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro2-methylfluoran, 7-diethylamino-2,3-dimethylfluoran, 7-diethylamino(3-acetylmethylamino)fluoran, 7-diethylamino(3-methylamino)-fluoran, 3, 7-diethylaminofluoran, 7-diethylamino-3-(dibenzylamino)fluoran, 7-diethylamino3-(methylbenzylamino)fluoran, 7-diethylamino-3-(chloroethylmethylamino)fluoran and 7-diethylamino-3-(diethylamino)fluoran. Specific examples of thiazine compounds include benzoyl leuco Methylene Blue and p-nitrobenzyl leuco Methylene Blue. Specific examples of spiro compounds include 3-methyl-spiro-dinaphthopyran, 3-ethyl-spiro-dinaphthopyran, 3,3'-dichlorospirodinaphthopyran, 3-benzyl-spiro-dinaphthopyran, 3-methylnaphtho-(3-methoxybenzo)spiropyran and 3-propyl-spirodibenzopyran. These compounds may be used alone or as a mixture.

The color former is coated on a support after being dissolved in a solvent and then encapsulated in the microcapsules.

Suitable solvents include a natural or synthetic oil alone or in a combination thereof. Examples of the solvent include cotton seed oil, kerosene oil, paraffin, naphthene oil, alkylated biphenyls, alkylated terphenyls, chlorinated paraffins, alkylated naphthalenes, diphenylalkanes, etc. For preparation of the color former containing microcapsules, for example, an interfacial polymerization method, an internal polymerization method, a phase separation method, an external polymerization method, a coacervation method, etc., can be utilized as described in U.S. Pat. Nos. 2,800,457, 2,800,458, 3,287,154, 3,418,250 and 3,726,804.

For the purpose of intensifying the adhesion strength, the binder may further contain, in addition to the above mentioned copolymer latex, a water-soluble polymer such as polyvinyl alcohol, starch, dextrin, carboxymethyl cellulose, hydroxyethyl cellulose, casein, etc., if desired. Further, the binder may also contain a capsule-protecting agent such as cellulose powder, starch grains, talc, etc., as well as other auxiliary agents such as antifoaming agents, waterproofing agents, ultraviolet absorbing agents, basic pigments, etc., as desired.

Examples of the developer which can react with the color former incorporated into the recording sheet of the present invention include, for example, clay substances such as terra alba, activated clay, attapulgite, zeolite, bentonite or kaolin, metal salts of aromatic carboxylic acids and phenol resins as described in U.S. Pat. Nos. 3,843,383,3,856,553, 4,559,242, 4,601,920, 4,076,887 and 3,970,769.

The developer is coated on a support such as paper, a plastic sheet (e.g., PET, PE, etc.), preferably paper, together with a binder such as styrene-butadiene latex.

The microcapsule sheet for pressure-sensitive recording of the present invention was tested using the following developer sheet.

The present invention is now described with reference to the following specific examples, but the present invention is not to be construed as being limited thereto. Unless otherwise indicated, all parts, percents and ratios are by weight.

Preparation of Developer Sheet 2 parts of zinc oxide, 18 parts of calcium carbonate and 4 parts of zinc 3,5-di-α-methylbenzylsalicylate (each having a particle size of from 1 to 1.5 μm, measured by a microtrack) were added to 70 parts of water and blended and then dispersed for 30 minutes with an attriter. To the resulting composition were added 2.5 parts (as solids) of a carboxy-modified SBR latex (55/37/5/3 by weight copolymer of styrene/butadiene/methyl methacrylate/itaconic acid, SN-307, made by Sumitomo Naugatuc Co., Ltd.) having a particle size of 0.2 μm and 12 parts of an aqueous 10 wt% PVA (saponification degree 99%, polymerization degree 1,000) solution, and the whole was uniformly stirred to obtain a coating composition. This was coated on a 50 g/m$^2$ base baper in an amount of 4 g/m$^2$ (as solids) with an air knife coater and dried to obtain a developer sheet.

EXAMPLES 1 TO 5

As a water-soluble polymer was used a partial sodium salt of polyvinylbenzenesulfonic acid (VERSA TL 500, by National Starch Co., mean molecular weight 500,000). 5 g of VERSA TL 500 was added to 95 g of a hot water of about 80° C. with stirring and dissolved and then cooled. The resulting solution had a pH value of from 2 to 3, and an aqueous 20 wt% sodium hydroxide solution was added thereto to adjust the pH value of the resulting aqueous water-soluble polymer solution to 6.0.

Separately, as a color former 5 g of Crystal Violet Lactone (CVL), 1.5 g of 3-[4-(diethylamino)-2-ethoxyphenyl]-3-(2-methyl-1-octyl-3-indolyl)-4azaphthalide and 1.0 g of 3,3-bis(1-n-octyl-2-methylindol3-yl)phthalide were dissolved in 100 g of KMC-113 (alkylnaphthalene consisting mainly of diisopropylnaphthalene, manufactured by Kureha Chemical, Japan) under heat (about 90° C.) to obtain a hydrophobic solution to be encapsulated. The resulting hydrophobic solution was cooled to 20° C., and then 0.3 g of 4,4'-diphenylmethane diisocyanate (MDI) polymer (polymerization degree: n=0, 85–90%, n>, 10–15%) mixture (Millionate MR100, manufactured by Nippon Polyurethane Industrial Co., Japan) as a poly isocyanate and 0.1 g of beef tallow alkylpropylenediamine (Nissan Amine DT, manufactured by Nippon Fat and Oil Co., Japan) as an amine compound were dissolved in the solution. The thus prepared solution was added to the above described aqueous water-soluble polymer solution with vigorous stirring and emulsified to form an O/W emulsion. After the resulting oil drop size became 5.0 μm (number mean value), the sitrring was stopped, and thus an emulsion was obtained.

Separately 6 g of melamine, 11 g of an aqueous 37 wt % formaldehyde solution and 83 g of water were heated at 60° C. with stirring, and after 30 minutes a transparent aqueous mixture solution of melamine, formaldehyde and melamine-formaldehyde primary condensation product was obtained. The thus prepared aqueous mixture solution had a pH value of from 6 to 8. This was added to the above described emulsion and blended, and an aqueous 10 wt % phosphoric acid solution was added thereto to adjust the pH value of the resulting liquid to 6.0. The temperature of the liquid was elevated to 65° C. and the liquid was continuously stirred for about 1 hour and thus the encapsulation was completed.

The capsule-containing liquid was cooled to room temperature, and the pH value thereof was adjusted to 9.0 with a 20 wt % sodium hydroxide. The capsule-containing liquid, the copolymer latex (Nos. 1 to 5) shown in Table 1 below, polyvinyl alcohol (saponification degree 88%, polymerization degree 500), basic pigment (Unibur 70, manufactured by Shiraishi Industrial Co., Japan) and starch grains (mean grain size, 15 μm) were blended in the proportion as mentioned below to obtain a capsule-containing coating composition, the total solid content in the composition being 20%. These are samples of Examples 1 to 5.

| | |
|---|---|
| Microcapsules | 100 parts by weight (as solids) |
| Copolymer Latex | 35 parts by weight (as solids) |
| Polyvinyl Alcohol | 10 parts by weight (as solids) |
| Basic Pigment | 8 parts by weight (as solids) |
| Starch Grains | 40 parts by weight (as solids) |

EXAMPLES 6 TO 10

Encapsulation was effected in the same manner as in Examples 1 to 5 except that the kind of the color former was changed, or that is, 100 g of Hysol SAS (manufactured by Nisseki Chemical Co., Japan) containing 3.6 g of 2-anilino-3-methyl-6-(N-ethyl-N-isopentylamino)-fluoran, 1.0 g of 3-diethylamino-7-dibenzylaminofluoran, 0.8 g of 3, 6-bisdiphenylaminofluoran and 0.7 g of 3-chloro-6-N-cyclohexylaminofluoran as dissolved therein was used for encapsulation. As a copolymer latex was used the compound shown in Table 1 (Nos. 6 to 10). Thus the respective capsule-containing coating compositions were prepared, which were the samples of Examples 6 to 10.

COMPARATIVE EXAMPLES 1 TO 3

The same process of Examples 1 to 5 was repeated except that the compound Nos. (a) to (c) shown in Table 2 below were used as the copolymer latex. Thus, the samples of Comparative Examples 1 to 3 were prepared.

COMPARATIVE EXAMPLES 4 TO 6

The same process of Examples 6 to 10 was repeated except that the compound Nos. (d) to (f) shown in Table 2 below were used as the copolymer latex. Thus, the samples of Comparative Examples 4 to 6 were prepared.

The thus prepared capsule-containing coating composition was coated on a 40 g/m$^2$ base paper with an air knife coater in a dry weight of 4.0 g/m$^2$ and then dried to obtain a microcapsule sheet.

Each of the above mentioned microcapsule sheets was superposed in face-to-face relation with the developer sheet mentioned above and subjected to evaluation as a pressure-sensitive recording sheet. The results obtained are shown in Table 3 below. The respective evaluation tests are described below.

(1) Color Stain:

Two microcapsule sheets were superposed and rubbed five times under a load of 1 kg/m$^2$, and the degree of the color stain on the capsule-containing surface after one day was observed.

(2) Color Stain by Exposure:

Two microcapsule sheets were rubbed under the same conditions as (1) and then exposed for 1 hour with a Xenon Fade-0-Meter (Suga Tester, FAL-25AX-HC Type). The degree of color stain and discoloration was observed.

The degree of the stain in (1) and (2) was evaluated on the basis of the following standards.

A: No stain
B: Slight stain
C: Stain
D: Extreme stain (3) Fog during Printing:

The microcapsule sheets for pressure-sensitive copying prepared in the Examples and Comparative Examples were subjected to printing on the capsule-containing surface by letterpress printing, and the printed surface was attached to the developer-containing surface of a developer sheet. These were kept in an atmosphere of 25° C. and 65% RH under a load of 50 g/cm$^2$ for 1 week. After week 1, the developer sheet was released and the degree of fogging was observed. The fog by printing was evaluated on the basis of the following standards.

A: No fog
B: Slight fog
C: Fog
D: Extreme fog

TABLE 1

| | Copolymer Latex of the Invention | | | | | | | | | |
|---|---|---|---|---|---|---|---|---|---|---|
| Monomer: | 1 | 2 | 3 | 4 | 5 | 6 | 7 | 8 | 9 | 10 |
| 1,3-Butadiene | 30 | 35 | 45 | 45 | 50 | 33 | 40 | 50 | 53 | 37 |
| Styrene | 55 | 35 | 45 | 35 | 30 | 35 | 40 | 37 | 30 | 40 |
| Acrylic Acid Amide | 5 | 10 | 4 | 5 | — | 15 | 4 | — | — | 3 |
| Methacrylic Acid Amide | — | — | — | — | 10 | — | — | 3 | 5 | — |
| Acrylonitrile | 10 | 15 | 5 | 10 | 10 | 15 | — | 10 | 10 | 20 |
| Methyl Methacrylate | — | — | 1 | 5 | — | 2 | 16 | — | — | — |
| Divinylbenzene | — | 5 | — | — | — | — | — | — | 2 | — |

TABLE 2

| | Comparative Compound No. | | | | | |
|---|---|---|---|---|---|---|
| Monomer: | a | b | c | d | e | f |
| 1,3-Butadiene | 40 | 15 | 85 | 53 | 75 | 10 |
| Styrene | 50 | 80 | 7 | 37 | 15 | 75 |
| Acrylic Acid | 10 | 5 | 5 | 5 | — | — |
| Itaconic Acid | — | — | — | — | 5 | 5 |
| Acrylonitrile | — | — | — | — | 5 | 10 |
| Methyl Methacrylate | — | — | 3 | 5 | — | — |

TABLE 3

| Run No. | Color Stain | Color Stain by Exposure | Fog during Printing |
|---|---|---|---|
| Example 1 | A | A | B |
| Example 2 | A | A | A |
| Example 3 | A | B | A |
| Example 4 | A | A | A |
| Example 5 | A | A | A |
| Example 6 | B | B | A |
| Example 7 | A | A | A |
| Example 8 | B | A | A |
| Example 9 | A | A | A |
| Example 10 | A | A | B |
| Comparative Example 1 | D | D | A |
| Comparative Example 2 | C | D | D |
| Comparative Example 3 | C | D | A |
| Comparative Example 4 | C | D | A |
| Comparative Example 5 | C | D | A |
| Comparative Example 6 | C | C | D |

The results of Table 3 demonstrate that the microcapsule sheets for pressure-sensitive copying using the copolymer latex of the present invention were excellent in printing fog resistance and color stain resistance. Thus, the present invention provides microcapsule sheets for pressure-sensitive copying of high quality.

While the invention has been described in detail and with reference to specific embodiments thereof, it will be apparent to one skilled in the art that various changes and modifications can be made therein without departing from the spirit and scope thereof.

What is claimed is:

1. A pressure-sensitive microcapsule sheet comprising a support having thereon a pressure-sensitive layer comprising microcapsule containing an electron donating color former dissolved in a solvent and a binder comprising a copolymer latex comprising an ethylenically unsaturated acid amide monomer and at least one monomer selected from the group consisting of an aliphatic conjugated diolefin monomer, an aromatic vinyl monomer, and an ethylenically unsaturated nitrile monomer.

2. The pressure-sensitive microcapsule sheet as claimed in claim 1, wherein said copolymer latex comprises from about 15 to 70 wt % of said aliphatic conjugated diolefin monomer, from about 10 to 70 wt % of said aromatic vinyl monomer, from about 0.5 to 20 wt % of said ethylenically unsaturated acid amide monomer and from about 3 to 30 wt % of said ethylenically unsaturated nitrile monomer.

3. The pressure-sensitive microcapsule sheet as claimed in claim 2, wherein said copolymer latex comprises from about 30 to 60 wt % of said aliphatic conjugated diolefin monomer, from about 20 to 60 wt % of said aromatic vinyl monomer, from about 3 to 15 wt % of said ethylenically unsaturated acid amide monomer and from about 5 to 20 wt % of said ethylenically unsaturated nitrile monomer.

4. The pressure-sensitive microcapsule sheet as claimed in claim 3, wherein said aliphatic conjugated diolefin monomer is selected from the group consisting of 1,3-butadiene, 2-methyl-1,3-butadiene, 2,3-dimethyl1,3-butadiene, and a butadiene substituted with a halogen; said aromatic vinyl monomer is selected from the group consisting of styrene, α-methylstyrene, vinyltoluene and monochlorostyrene; said ethylenically unsaturated acid amide monomer is selected from the group consisting of acrylic acid amide, N-methylolacrylamide, methacrylic acid amide, crotonic acid amide, cinnamic acid amide, itaconic acid amide, fumaric acid amide, maleic acid amide, itaconic acid amide monoethylester, fumaric acid amide monoethylester and maleic acid amide monoethylester; and said ethylenically unsaturated nitrile monomer is selected from the group consisting of acrylonitrile, methacrylonitrile and α-chloroacrylonitrile.

5. The pressure-sensitive microcapsule sheet as claimed in claim 2, wherein said copolymer latex further comprises a copolymerizable olefinic monomer.

6. The pressure-sensitive microcapsule sheet as claimed in claim 5, wherein said copolymerizable monomer is selected from the group consisting of methyl acrylate, methyl methacrylate, ethyl acrylate, butyl acrylate, glycidyl acrylate, glycidyl methacrylate, acrolein, allyl alcohol, divinylbenzene, diallyl phthalate, diallyl maleate, triallyl cyanurate, ethylene glycol dimethacrylate, allyl acrylate and vinylpyridine.

7. The pressure-sensitive microcapsule sheet as claimed in claim 1, comprising from about 10 to 90 parts by weight of said copolymer latex per 100 parts by weight of said microcapsules.

8. The pressure,-sensitive microcapsule sheet as claimed in claim 7, comprising from about 15 to 70 parts by weight of said copolymer latex per 100 parts by weight of said microcapsules.

9. The pressure-sensitive microcapsule sheet as claimed in claim 1, wherein said microcapsules are pressure-rupturable microcapsules.

10. The pressure-sensitive microcapsule sheet as claimed in claim 9, wherein said color former is selected from the group consisting of a triarylmethane compound, a diphenylmethane compound, a xanthene compound, a thiazine compound, a spiro compound, and a mixture of these compounds.

11. A pressure-sensitive recording material comprising (a) a pressure-sensitive microcapsule sheet comprising a support having thereon a pressure-sensitive layer comprising microcapsules containing a color former dissolved in a solvent and a binder comprising a copolymer latex comprising an ethylenically un saturated acid amide misnomer and at least two monomer selected from the group consisting of an aliphatic conjugated diolefin monomer, an aromatic vinyl monomer, and an ethylenically unsaturated nitrile monomer, and (b) a recording layer comprising a binder and a developer capable of reacting with said color former to form a colored image, said recording layer being adjacent to said pressure-sensitive layer.

* * * * *